United States Patent [19]

Adair et al.

[11] 4,248,161

[45] Feb. 3, 1981

[54] ADJUSTABLE LOCKING MECHANISM FOR TILTING TABLES AND THE LIKE

[75] Inventors: William A. Adair, Des Plaines, Ill.; Lyle A. Johnson, Spencer, Wis.

[73] Assignee: Teledyne Industries, Inc., Los Angeles, Calif.

[21] Appl. No.: 945,134

[22] Filed: Sep. 22, 1978

[51] Int. Cl.[3] ..... A47F 5/12

[52] U.S. Cl. ..... 108/6; 297/373

[58] Field of Search ..... 108/6, 8, 1; 248/477, 248/479; 297/373

[56] References Cited

U.S. PATENT DOCUMENTS

| | | | |
|---|---|---|---|
| 3,206,268 | 9/1965 | Grow et al. | 108/6 X |
| 3,698,328 | 10/1972 | Weir | 108/6 |
| 3,756,166 | 9/1973 | Piretti | 108/6 |

FOREIGN PATENT DOCUMENTS

| | | | |
|---|---|---|---|
| 907975 | 2/1954 | Fed. Rep. of Germany | 297/373 |
| 1054858 | 4/1959 | Fed. Rep. of Germany | 297/373 |
| 510360 | 10/1953 | Italy | 297/373 |
| 494590 | 3/1954 | Italy | 297/373 |
| 504296 | 12/1954 | Italy | 297/373 |

*Primary Examiner*—Roy D. Frazier
*Assistant Examiner*—Peter A. Aschenbrenner
*Attorney, Agent, or Firm*—Lockwood, Dewey, Alex & Cummings

[57] ABSTRACT

Two sets of positive-locking tilt adjustment mechanisms are mounted between a drafting board and a supporting frame therefore. Both sets of locking mechanisms include identical left and right halves having crown gear portions positioned thereon for aligned meshing engagement with each other. Further, the opposing halves of the opposing sets of mechanisms are also aligned. Each half is manually mountable by hand to either the board or frame and a bolt and hand tightenable nut maintain the sets of mechanisms, the board, and the frame in adjustable alignment. The board and frame are made such that loosening a nut on each mechanism automatically separates the halves of each set thereof for providing interference free tilting adjustment of the drafting board on the frame.

8 Claims, 9 Drawing Figures

FIG. 4
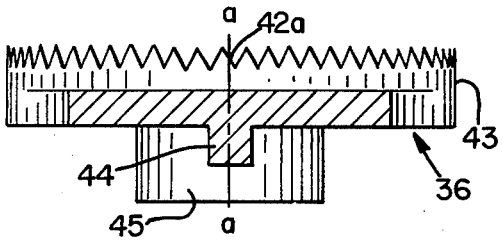
FIG. 5
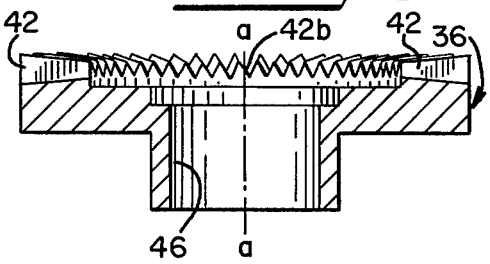
FIG. 6
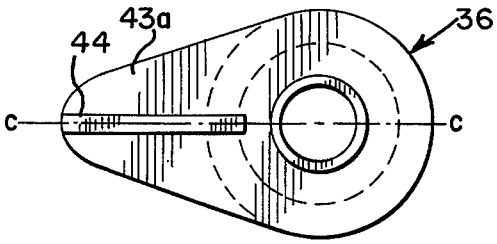
FIG. 7
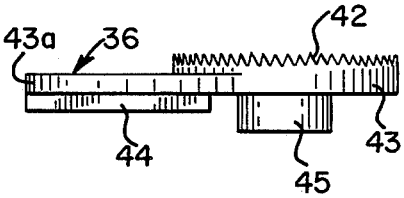
FIG. 8
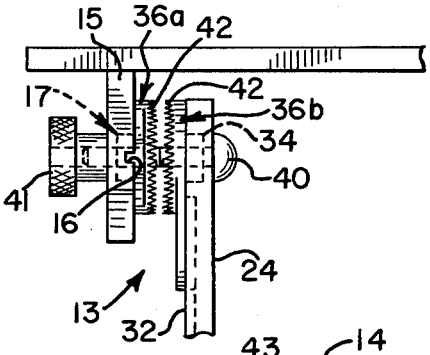
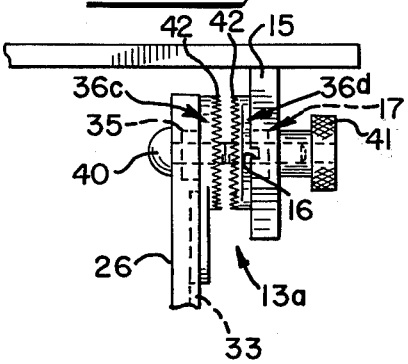
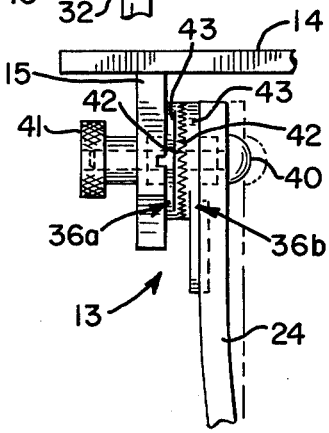
FIG. 8A

ADJUSTABLE LOCKING MECHANISM FOR TILTING TABLES AND THE LIKE

This invention relates generally to improvements in locking mechanisms for tilting tables, and, more specifically, to a simplified mechanism for adjustably tiltably mounting a drafting surface to a stationary frame.

The use of mating crown gear members, or rosettes, on tables for locking a tilting table top thereon is, in the broad sense, known. However, as far as is presently known, such use has included either a single set of mating rosettes, or two sets of mating, but not identical, rosettes.

Heretofore known drafting tables have included board locking mechanisms providing for a continuously adjustable angle of tilt between the board and frame. One such mechanism, shown in U.S. Pat. No. 3,389,520, includes a slotted semi-annular guide mounted on the board, and a clamp on the frame which extends through the curved guide slot. The clamp consists of a bolt retained on the frame, and a nut, in the form of a hand tightenable knob, which can be drawn down on the bolt to bind the guide on the frame. While this locking mechanism provides adjustment of the table to any desired degree of tilt, the frictional type clamp does not provide a positive locking engagement. Therefore, the application of leverage to the board, such as by a user leaning thereon, may cause the guide to slip on the clamp, resulting in undesirable movement of the drafting board.

Therefore, a need has developed for an improved and simplified locking mechanism for a tilting table which provides for positive locking tilt adjustment without resorting to the use of hand tools to tighten or loosen same.

It is therefore an object of the present invention, generally stated, to provide an improved and simplified positive-locking mechanism for a tilting table.

A more specific object of the invention is the provision of a simplified locking mechanism for a tiltable drafting table including four identical rosette type members positioned in opposed aligned sets with meshing engagement in each set, and each rosette being interchangeably mountable on the table without the use of hand tools.

Another more specific object of the present invention is the provision of a positive locking mechanism for a tilting table which coacts with the table to provide interference free tilting of the table top when desired.

Applicants' invention is directed to a positive-locking mechanism positioned between a tiltable table top and a substantially stationary base or frame. The mechanism includes four substantially identical mating members having crown gear portions or rosettes thereon and being adapted for coaxial multi-position meshing engagement therebetween in two sets. Each gear portion has a plurality of gear teeth or crenulations positioned on one surface thereof annularly around a central axis. The opposing surface of the gear portion includes an axially extending annular flange for preventing translational movement between the member and the structure in which it is mounted, and a radially extending keel or flange which is keyed for preventing rotational movement between the member and the structure in which it is mounted. The table framework and the top structure are both provided with annular flange and keel flange receiving slots and holes, respectively, which are sized for manual (hand) mounting of the mating members therein.

The invention is further directed to a tilt mechanism member having a crown type gear or rosette positioned thereon as defined above wherein the intersection of a plane defined by the axis of the gear and a centerline of the keel flange key thereon intersects a pitch surface of a tooth on said gear between an addendum (apex) and dedendum (root) thereof. Such positioning of the teeth on the gear member assures parallel alignment of the keel centerlines of opposing pairs of members mounted respectively on board and frame, and throughout the range of tilt adjustment so that each position of locking mesh is common to all members.

Certain more specific objects and several advantages of the present invention will become apparent from the following detailed description of a presently preferred embodiment thereof taken in conjunction with the accompanying drawings, wherein:

FIG. 4 is a cross-sectional view taken on line 4—4 of FIG. 3;

FIG. 5 is a cross-sectional view taken on line 5—5 of FIG. 3;

FIG. 6 is a side elevational view of the side of the mating member opposite that shown in FIG. 3;

FIG. 7 is a top plan view, on enlarged scale, of the mating member taken on line 7—7 of FIG. 3;

FIG. 8 is a fragmentary elevational view, on enlarged scale, taken generally on line 8—8 of FIG. 1 showing two sets of tilt mechanism members in an unbiased (unlocked) position; and FIG. 8*a* is a fragmentary sectional view similar to the left half of FIG. 8 showing one set of mating members in a biased (locked) position.

Figure 1:
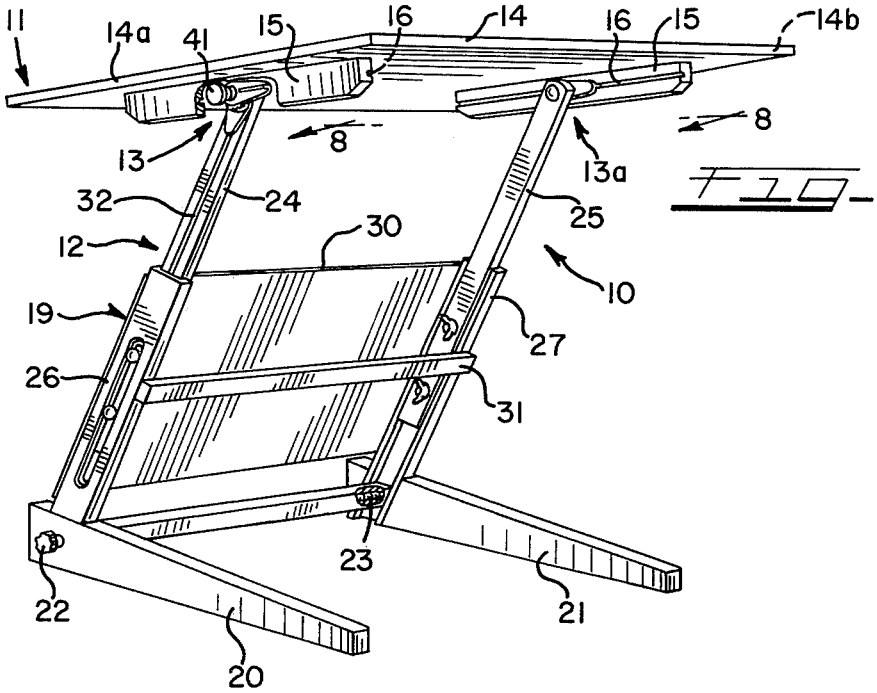
FIG. 1 is a perspective view of a drafting table in which a preferred embodiment of the present invention has been incorporated.

Referring to FIG. 1, a drafting table, indicated generally at 10, incorporating a preferred embodiment of the present invention, includes a drafting board assembly 11, which is mounted on top of a framework or support 12 by two sets of identical tilting mechanisms, the sets being generally indicated at 13 and 13*a* for clarity.

The drafting board assembly 11 includes a relatively large flat rectangular drafting board 14 which, in this embodiment, has a pair of opposed cleats 15—15 mounted on the bottom of the board adjacent and parallel to each of the opposed shorter side edges 14*a*-14*b* (only one shown) thereof. The inwardly facing side surface of each cleat 15 includes a slot 16, which, for ease of manufacture, extends along the length thereof, and a counter-bored hole 17 (FIGS. 8 and 8*a*) centrally positioned along the slot which extends through the cleat or mounting member 15. The purpose of slots 16 and counter-bored holes 17 will be discussed in greater detail below.

The table framework 12 includes a central body portion generally indicated at 19, a pair of parallel foot members 20-21 which are releasably mounted to the bottom of body portion 19, at 22, and 23, disposed horizontally, and spaced apart a distance approximating that between the cleats 15—15, and a pair of arm members 24, 25 which are each slidably adjustably retained on the body 19 in the interior of one of a pair of parallel, spaced apart leg channels 26, 27 therein. The body 19 of framework 12 further includes a so-called modesty board 30 extending across the front and between leg channels 26, 27 and a bracing bar 31 extending across the back and between the leg portions. It should be noted that the locking mechanisms 13-13*a* of the invention and the releasable mountings 22, 23 allow the drafting board assembly 11 and the foot members 20-21, respectively, to be rotated substantially parallel to the body 19, thus providing a thin table profile, when folded, for ease of shipping and storage. In the trade, the style of drafting table shown in known as a "Z" table.

Arm members 24, 25 at their upper distal ends each includes a counter-bored mounting hole 34, 35, respectively, (FIG. 8) which is identical to counter-bored holes 17—17 in the cleats 15. Each hole 34 or 35 is centered on the elongate slot 32, 33 in its support arm 24 or 25.

Figure 2:
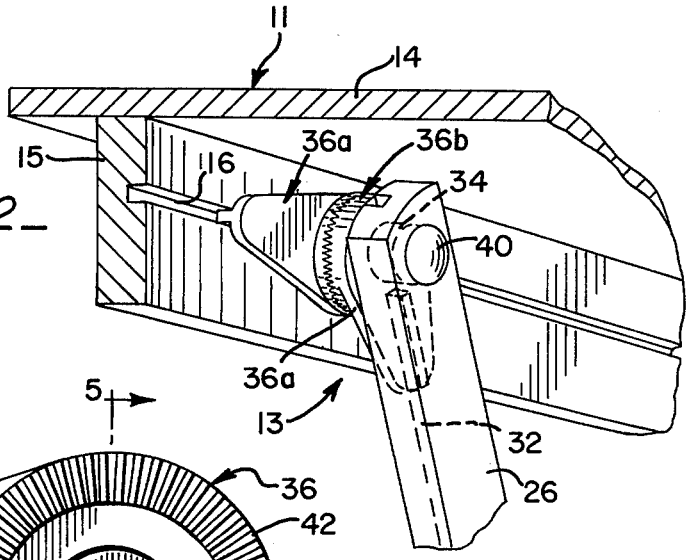
FIG. 2 is an isometric view, on enlarged scale, of one pair of the tilting mechanisms of the invention shown in FIG. 1.
Figure 3:
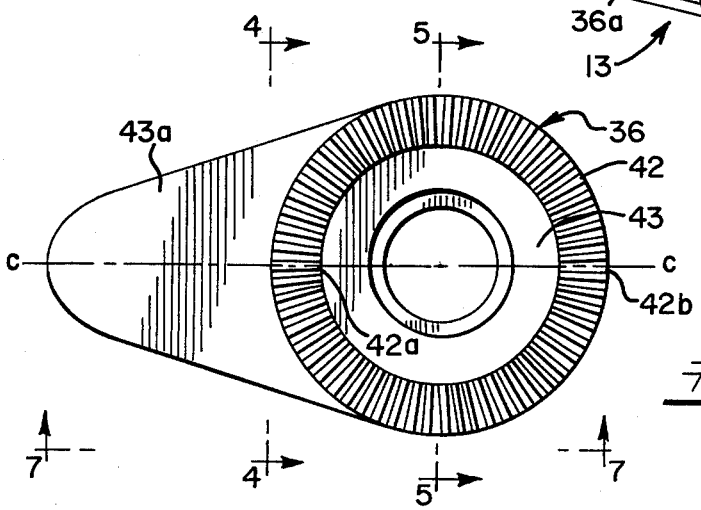
FIG. 3 is a side elevational view, on enlarged scale, of one of the tilt mechanism mating members shown in FIG. 1.

Referring to FIG. 2, one locking mechanism 13 of the pair thereof mounted on table 10 as shown in FIG. 1, includes two identical matingly engaged rosette members, both generally indicated by the number 36, and each identified by one of the subletters a or b, respectively. One base member 36*a*includes a key 37 (FIG. 4) and an annular flange 38 (FIG. 4), both on the back side thereof which are press-fitted by hand into the slot 16 and mounting hole 17 (not shown) of the cleat 15 such that the member 36*a* is fixed against both translational and rotational movement thereon. The mating base member 36*b* is press-fitted by hand into the mounting hole 34 and slot 32 of arm member 24 in a like manner such that it is also fixed against translational and rotational movement thereon. A carriage bolt 40, extends through the mounting holes and aligned apertures in the base members such that its threaded end is positioned outwardly of the cleat 15, but may be extended inwardly, if desired. The bolt is retained in position by a knob over-molded nut 41 (FIG. 1) which is hand tightenable. Meshing engagement of the set of base members 36*a*-36*b*, and the opposed set 36*c* and 36*d*, when the bolts 40—40 and the nuts 41—41 are fastened, securely locks the drafting board assembly 11 in a fixed position relative the frame 12.

More specifically, the single piece base member 36, shown in detail in FIGS. 3-7, includes a plurality of gear teeth 42—42 (60 teeth in this embodiment) formed on a front side thereof and arranged radially annularly around a central axis a—a to define a crown-type gear portion or rosette 43. An eccentric flange or keel 43*a*, extends from gear portion 43 perpendicularly to the member axis a—a, and provides a base for the elongate key 44 (FIGS. 6-7). Key 44 is positioned along the centerline c—c of flange 43*a* extending outwardly thereof on the back side member 36. The annular flange 45 is concentric with axis a—a and extends axially outwardly of the back side of the rosette. As shown most clearly in FIG. 5, the inner surface 46 of annular flange 45 defined a hollow bearing surface through which bolt 40 is inserted. Note also in FIG. 5 that the crown gears 42—42 have opposed conventional flat trapezoidal shape faces such that the addendums (apexes) of the teeth define a cone. The dedendums (roots) of the teeth define an opposing cone such that the respective cones would join at a point along the axis a—a of the member 36.

One aspect of the present invention relates to positioning teeth 42—42 on rosette 43 so that they intersect a plane defined by axis a—a and the centerline c—c of the keel flange 43*a* midway along the flat side surface of two diametrically opposing teeth (for example, 42*a*, 42*b*, of FIGS. 3 and 4) thereon, and not along the addendums (apexes) or dedendums (roots) thereof. This feature has two benefits. First, all four mating members 36—36 may be made identical, i.e. from one mold, and second, it allows the opposing sets of mating members 13 and 13*a* to be positioned in meshed and completely parallel alignment with one another, i.e. the outward pair of members 36*a*, 36*d* on the cleats are in parallel alignment, and the inward pair of members 36*b*, 36*c*, on the arm members are also in parallel alignment. It should be noted that the outward pair of members could be positioned 180° out of phase with each other and still be in parallel alignment.

As an example showing both benefits, if the predefined plane a—a, c—c intersected teeth 42*a*, 42*b* on member 36*a* at their addendums, a mating member 36 would have to have its plane a—a, c—c intersect its teeth 42*a*, 42*b* at their dedendums, for the keys of the mating members to be in alignment. Therefore, two differing members 36 would have to be made to provide mating engagement when their keels were parallel. The importance of this alignment is shown in FIG. 8 where the pair of members 36*a* and 36*d* have their keys parallel in slots 16, 16, respectively. Also, the pair of members 36*b* and 36*c* have their keys parallel in slots 32, 33, respectively. If the teeth of members 36*a* and 36*d* are not in mating alignment, i.e. aligned so that plane a—a, c—c intersects teeth 42*a*, 42*b* midway across their faces, and likewise with members 36*b* and 36*c*, both sets of tilting mechanisms 13-13*a* will not mesh in unison. With the gear member teeth made as described, both sets of the tilting mechanisms, made up of four identical members, will mesh in unison. It is easily recognized that replacement part inventory with identical mating members may be one half of the inventory necessary if two differing mating members were utilized.

A further aspect of the present invention is also shown in FIGS. 8 an 8*a* wherein the spatial distance between arm members 24, 25 relative the spatial distance between the cleats 15—15, when the pivotal adjustment mechanism is in an unlocked position, is sufficient to provide interference free tilting adjustment of the drafting board assembly 11. This spatial difference is greater than the thickness of four rosettes 43—43. However, as shown most clearly in FIG. 8*a*, when the tilting mechanism is in a locked position, the resiliency in arm 24 allows it to bend outward toward the cleat 15 until the teeth 42—42 on opposed mating members 36*a*-36*b* engage.

While one preferred embodiment of the present invention has been shown and described, it will be understood that modifications and variations may be affected without departing from the invention in its broader aspects. Therefore, the aim in the appended claims is to cover all such modifications and variations as fall within the true spirit and scope of the invention.

We claim:

1. In a locking mechanism for a tilting table of the type having a supporting frame, and a table top tiltably mounted on said frame, said locking mechanism being positioned between said top and said frame, the improvement in said locking mechanism comprising: four identical mating members having crown gear portions positioned on one side of each member around a central axis thereof for positive-locking multi-position meshing engagement with each other in pairs, and flange means on an opposing side of each said member for preventing rotational movement of said member relative at least one of said frame and said table top, and at least one position of possible meshing engagement between said mating members providing parallel alignment between said flange means and wherein said opposing side of each said member further includes an annular axially extending flange for preventing translational movement of said member relative at least one of said frame and said table top, and an interior of said annular flange defines a bearing surface coaxial with said crown gear portion.

2. The locking mechanism as defined in claim 1 wherein both said table top and said supporting frame include recesses thereon in which said flange means and said annular flange are adapted to be press-fit therein by hand.

3. In a locking mechanism for a drafting table of the type having a supporting framework, and a table top structure tiltably mounted on said supporting framework, an improvement in said locking mechanism comprises: Four identical crown-type gear members adapted for coaxial multiposition meshing engagement in opposed pairs thereof, each said member having a plurality of gear teeth positioned on one side thereof extending radially outwardly of a central axis thereof, an opposing surface of said gear member including first flange means for preventing rotational movement of said member relative one of said top structure and said framework, second flange means for preventing transilatory movement of said member along one of said top structure and said framework, and both said framework and said top structure including first and second flange means receiving recesses for allowing said gear members to be manually secured therein.

4. The crown type gear member as defined in claim 3 wherein said first flange means is a radially extending key and said receiving surface therefore is an enlongate slot in at least one of said framework and said top structure.

5. The crown type gear member as defined in claim 4 wherein said second flange means is an axially extending annular flange and said receiving surface therefore is a cylindrical bore in at least one of said framework and said top structure.

6. The crown type gear member as defined in claim 4 wherein the intersection of a plane defined by said axis of said gear and a centerline of said radially extending key, and one of said gear teeth is positioned midway on a pitch surface thereof between an addendum and a dedendum of said tooth for assuring parallel alignment between outward and inward members of said respective pairs of crown gear members.

7. The locking mechanism as defined in claim 3 wherein said table top structure includes a drafting board having a substantially flat upper working surface thereon, and an opposed lower surface including a pair of spatially related cleast extending substantially perpendicularly therefrom; said supporting framework includes a base portion, and a pair of parallel spatially related arm members extending generally upwardly from said base portion, both said pair of drafting board cleats and said pair of base arm members including cylindrical bores positioned therethrough defining said second flange receiving recesses, said bores being in coaxial alignment when said top structure is mounted on said supporting framework, and at least one elongate slot positioned adjacent each said cylindrical bore defining said first flange receiving recess; the improvement wherein the spatial distance between said pair of drafting board cleats less the axial thicknesses of a pair of crown gear members, as mounted thereon, is greater than the spatial distance between said pair of arm members plus the thickness of said arm members and the axial thicknesses of a pair of crown gear members, as mounted thereon, when said locking mechanism is in an unbiased position for providing interference free tilting movement between said top structure and said framework.

8. The locking mechanism as defined in claim 7 wherein at least one of said drafting board cleats and said pair of framework arm members is sufficiently resilient to allow meshing engagement of said pairs of crown gear members when said angular adjustment means is in a biased position.

* * * * *